US005584565A

United States Patent [19]

Berg

[11] Patent Number: 5,584,565

[45] Date of Patent: Dec. 17, 1996

[54] TOOL WITH WORKPIECE ILLUMINATION

[76] Inventor: Aaron R. Berg, 11706 N. 131st St., Scottsdale, Ariz. 85259

[21] Appl. No.: 578,243

[22] Filed: Dec. 28, 1995

[51] Int. Cl.[6] ..... B25B 23/18

[52] U.S. Cl. ..... 362/120; 362/208; 7/165

[58] Field of Search ..... 7/165; 362/109, 362/119, 120, 208, 32

[56] References Cited

U.S. PATENT DOCUMENTS

| | | | |
|---|---|---|---|
| 2,680,844 | 6/1954 | Smith | 362/208 |
| 2,761,057 | 8/1956 | Modell | 362/120 |
| 2,773,974 | 12/1956 | Markett | 362/120 |
| 3,510,643 | 5/1970 | File | 362/119 |
| 4,662,947 | 5/1987 | Hopkins | 362/120 |
| 4,936,171 | 6/1990 | Berg | 362/120 |
| 5,152,598 | 10/1992 | Schaffer | 362/120 |
| 5,318,009 | 6/1994 | Robinson | 362/120 |

*Primary Examiner*—Stephen F. Husar
*Assistant Examiner*—Alan B. Cariaso
*Attorney, Agent, or Firm*—Allan M. Shapiro

[57] ABSTRACT

The tool is a narrow one, usually a screwdriver or the like, formed of one piece of clear synthetic polymer composition material such as polycarbonate. The tool has a flange which fits into the front cover or shroud of the flashlight and overlies its lens. The shank extends out of the flange and is sized to engage upon a device needing adjustment. The end of the shaft has engagement means thereon which may be a flat screwdriver tip, a special screwdriver tip, or a socket so that an adjustment screw may be readily engaged even in a dark location.

20 Claims, 1 Drawing Sheet

FIG. 1
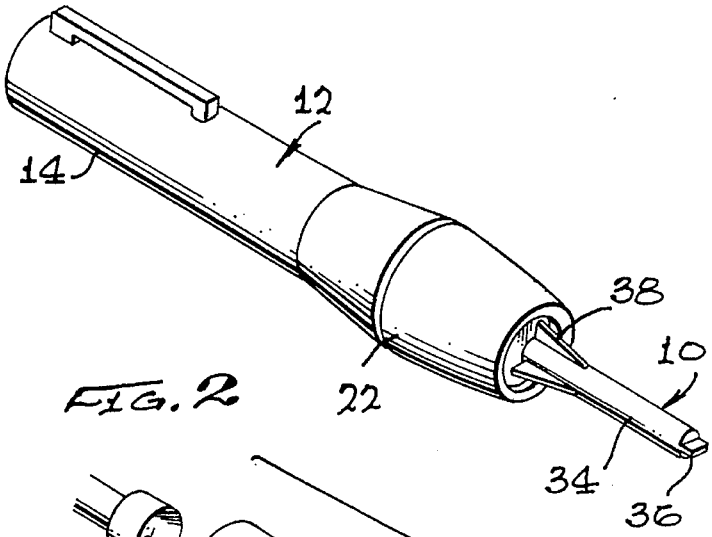
FIG. 2
FIG. 7
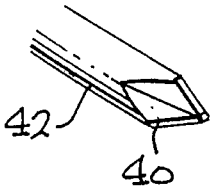
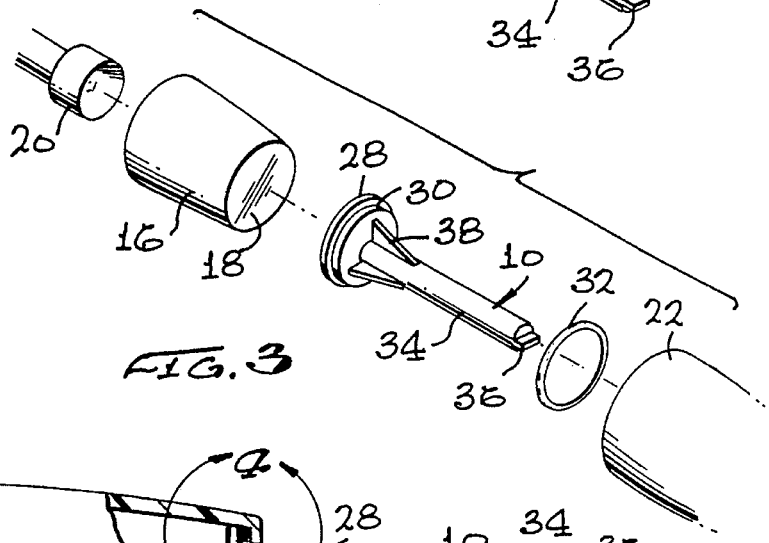
FIG. 3
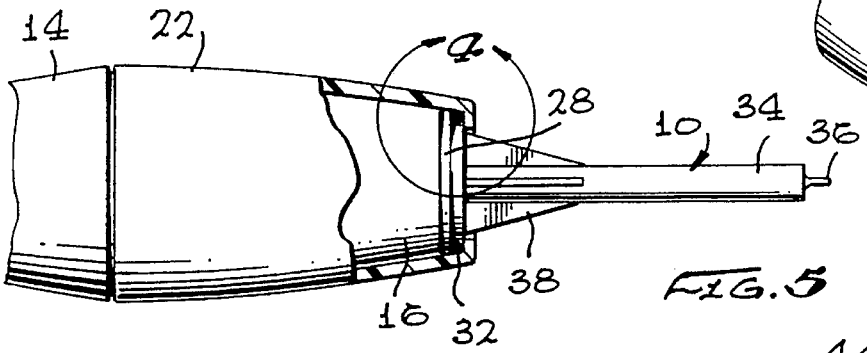
FIG. 5
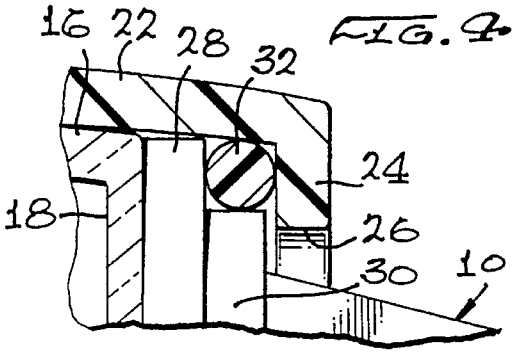
FIG. 4
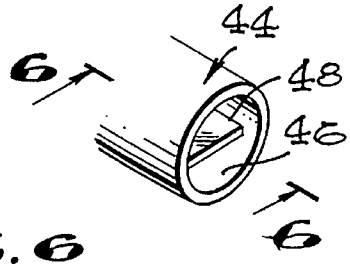
FIG. 6
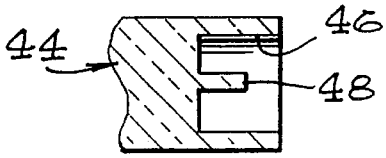

TOOL WITH WORKPIECE ILLUMINATION

FIELD OF THE INVENTION

This invention is directed to a one-piece tool which is inserted into the front cover or shroud of a flashlight and which is retained on the flashlight so that light is delivered to the area immediately around the tip of the tool.

BACKGROUND OF THE INVENTION

There are a number of situations where rotation of an adjustment screw is required, but the illumination in the area of the screw is low and it is undesirable to add a substantial amount of ambient illumination in order to find the adjustment screw. In sound recording studios, sound is received from many microphones. Each sound source is filtered into many frequency bands, in a recording device, for example. These many bands are selectively recombined, and with a skilled sound engineer, a very desirable result is achieved. The control boards which are used for these purposes have many potentiometers or other adjustable devices therein for management of each band. Each is provided with an adjustment screw which may be behind a hole in the control panel. It is in such a structure where it is desirable to provide a tool with workpiece illumination. Similar situations arise in television stations, radio stations, computer installations, in adjusting aerospace equipment and adjusting radio communications equipment. In other fields, it is also helpful to have illumination at the screwdriver tip. This occurs in industries such as jewelry repair, television and video cassette recorder repairs, and in various hobbies. There are a number of situations wherein the turning, adjusting or aligning of small screws is required and illumination is helpful in finding those screws.

There are various small screwdrivers in the art, and most of these are suitable for making the necessary adjustments, but the direct illumination of the screw to be engaged by the screwdriver for its adjustment is also helpful.

SUMMARY OF THE INVENTION

In order to aid in the understanding of this invention, it can be stated in essentially summary form that it is directed to a tool with workpiece illumination.

The tool is made of one-piece of clear polymer material, and it has a shank integrally formed with a flange. The flange engages behind the lamp cover or shroud of a flashlight and is retained therein sufficiently strongly to permit the shank which is integral with the flange to be employed for making adjustments in poorly illuminated locations.

It is a purpose and advantage of this invention to provide a tool with workpiece illumination which makes it convenient to reach and adjust small adjustable devices in poorly illuminated areas.

It is another purpose and advantage of this invention to provide a tool with workpiece illumination which includes a unitary flange and shank made of clear polymer material so that the tool serves as a light pipe directing illumination to the tip of the shank where it engages the device to be adjusted.

It is another purpose and advantage of this invention to provide a tool with workpiece illumination wherein the tool is a unitary flange and shank which can be readily molded and is inexpensive to make because there are no inserts or assembly steps required beyond placing the tool in the lamp cover of the flashlight.

The features of the present invention which are believed to be novel are set forth with particularity in the appended claims. The present invention, both as to its organization and manner of operation, together with further objects and advantages thereof, may be best understood by reference to the following description.

BRIEF DESCRIPTION OF THE DRAWINGS

FIG. 1 is an isometric view of a flashlight having in association therewith the tool with workpiece illumination, in accordance with this invention.

FIG. 2 is an exploded view thereof, with the body of the flashlight removed.

FIG. 3 is a side-elevational view of the flashlight, with parts broken away and parts taken in section.

FIG. 4 is an enlarged view of the portion 4—4 of FIG. 3.

FIG. 5 is an enlarged isometric view of a different tip on the tool.

FIG. 6 is an enlarged section taken generally along line 6—6 of FIG. 5.

FIG. 7 is an isometric view of another specific tip for use on the tool of this invention.

DESCRIPTION OF THE PREFERRED EMBODIMENTS

The tool of this invention is generally indicated at 10 in FIGS. 1, 2, 3 and 4. The tool 10 is used in association with the flashlight generally indicated at 12 in FIG. 1. A specific flashlight of the configuration described below is manufactured by Pelican Products, Incorporated of Torrance, Calif. 90501 under the name "Super MityLite™". In general, the flashlight 12 has a body 14 which contains batteries. Lamp housing 16 has a lens 18 at its forward end. Lamp and reflector 20 are normally housed within lamp housing 16 closely behind the lens 18. Circuitry and a switch selectively close the current path through the battery and the lamp. The switch may be actuated by any convenient means and, in the preferred embodiment of the flashlight, rotation of the lamp housing 16 with respect to the body selectively opens and closes the circuit. Cover or shroud 22 frictionally engages over the lamp housing to protect the lamp housing. The front of the cover has an inturned edge 24 which has a central opening 26, which is positioned over the lens 18. Cover 22 can be pulled off without disturbing the lamp housing 16 or any other parts of the flashlight.

Tool 10 is a unitary structure made of a one-piece molding of clear synthetic polymer composition material, such as polycarbonate. The tool includes a flange 28 which is circular to fit within cover 22, as seen in FIG. 4. The forward edge of flange 28 has an O-ring notch 30 in which lies O-ring 32. The O-ring engages against the inside of the inturned edge 24, as is best seen in FIG. 4. The O-ring has the function of sealing the outer edge of the flange with respect to the inside of the lamp housing. The interior of the cover 22 is configured to fit closely on the exterior of lamp housing 16 to provide a press-fit which holds the cover in place to retain the tool 10 in place. Forward of the flange, the tool has a shank 34 which terminates in a tool tip 36. The transition between the flange and the shank may be strengthened, if desired, by any convenient means such as webs 38. The webs 38 are flat triangular webs adjoining both the flange and the shank and are integrally formed therewith. The webs 38 are positioned around the shank, such as at 90 degrees with respect to each other, as shown in FIG. 3. Without the webs, the highest stress point would be the transition between the shank and the flange. The webs strengthen the tool at that location. Other configurations can be used for strengthening. However, since the tool is intended to be used in narrow places, the webs do not extend the full length forward to the tip. Instead, a substantial length of the shank extends beyond the end of the webs.

The tool tip 36 shown in FIGS. 1, 2 and 3 is a flat screwdriver tip. Other tips can be used alternatively, if desired. In fact, a similar tool having a different tip-would be fully interchangeable. Tool tip 40 on shank 42, shown in FIG. 7, is a Phillips screwdriver tip, which is also practical for use in some adjustment locations. Furthermore, the tool tip can be recessed so that, once engaged, the tool tip is resistant to dislodgement. This is accomplished by means of the tip 44 shown in FIGS. 5 and 6. In this case, the tip has a recess 46 in which is located flat blade screwdriver tip 48. When the tip 48 is approaching the head of the screw, particularly when the screw is in a recessed location, the recess 46 serves to assist in locating the screw head. When the screwdriver tip 48 is engaged on a slot in the head of the screw, the recess tends to hold the tool in position. Thus, adjustment is made easier.

The tool 10 is made of clear synthetic polymer composition material so that, when the flashlight is turned and the tool is in position, as shown in FIGS. 1 and 3, the light from the lamp in the flashlight projects forward both through the flange outside of the shank, but also travels to the tool tip by means of the light pipe effect of the flange. Thus, the light is delivered to the work point at the tool tip. While a water white clear synthetic polymer composition material is suitable for most cases, in those locations where white light is difficult, the tool can be made of clear material which only passes the red wavelengths so as not to interfere with night vision in places where there is darkness, such as the theater, an aircraft cockpit or a military vehicle.

This invention has been described in its presently contemplated best modes, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A tool configured for flashlight illumination comprising:

a unitary tool of one piece of transparent synthetic polymer composition material, said tool having a flange thereon sized to fit within and be embraced by the lens cover of a flashlight, said tool having a shank extending from said flange, said shank terminating at an engagement end away from said flange; and means on said engagement end for detachable engagement upon a device to be adjusted so that said engagement end is illuminated by a flashlight which embraces said flange with its lens cover.

2. The tool configured for flashlight illumination of claim 1 wherein said engagement means is a screwdriver tip.

3. The tool configured for flashlight illumination in accordance with claim 2 wherein said engagement means is a flat screwdriver tip.

4. The tool configured for flashlight illumination of claim 1 wherein said engagement means is one of: a Phillips screwdriver tip, and an Allen wrench tip.

5. The tool configured for flashlight illumination in accordance with claim 1 wherein said clear synthetic polymer composition material of said tool is water white.

6. The tool configured for flashlight illumination in accordance with claim 1 wherein said tool is formed of clear synthetic polymer composition material which passes light in the red spectrum band.

7. A tool with workpiece illumination comprising:

a unitary tool made of one piece of clear synthetic polymer composition material having a flange thereon and having a shank extending from said flange, said shank terminating in an engagement end, said engagement end being configured for engagement on a device to be adjusted by rotation;

a flashlight, said flashlight having a battery and a bulb, together with a reflector and lens in association with said bulb, said flashlight having a lens cover embracing said lens, said flange portion of said tool being sized to be embraced within said lens cover when said flange overlies said lens so that when said lamp is illuminated, light passes through said lens into said flange and through said tool to illuminate the area adjacent said engagement end of said tool.

8. The tool configured for flashlight illumination of claim 7 wherein said engagement end is a screwdriver tip.

9. The tool configured for flashlight illumination in accordance with claim 8 wherein said engagement end is a flat screwdriver tip.

10. The tool configured for flashlight illumination of claim 7 wherein said engagement end is one of: a Phillips screwdriver tip, and an Allen wrench tip.

11. The tool with workpiece illumination in accordance with claim 7 wherein there is a strengthener formed with said flange and said shank and positioned at the juncture of said flange and said shank so as to strengthen said juncture.

12. The tool with workpiece illumination of claim 11 wherein said strengthener comprises a plurality of webs which are joined both with said shank and with said flange.

13. The tool with workpiece illumination of claim 12 wherein said webs are positioned substantially equally spaced from each other around said shank.

14. The tool with workpiece illumination of claim 7 wherein there is an O-ring engaged between said flange and said lens cover to provide a seal therebetween.

15. The tool with workpiece illumination of claim 14 wherein said flange has an O-ring notch therein and said O-ring lies in said O-ring notch to retain said O-ring in compression against said flange and against said lens cover.

16. The tool with workpiece illumination in accordance with claim 14 wherein there is a strengthener formed with said flange and said shank and positioned at the juncture of said flange and said shank so as to strengthen said juncture.

17. The tool with workpiece illumination of claim 16 wherein said strengthener comprises a plurality of webs which are joined both with said shank and with said flange.

18. The tool with workpiece illumination of claim 17 wherein said webs are positioned substantially equally spaced from each other around said shank.

19. The tool configured for flashlight illumination of claim 18 wherein said engagement means is a screwdriver tip.

20. The tool configured for flashlight illumination in accordance with claim 18 wherein said engagement means is one of: a flat screwdriver tip, a Phillips screwdriver tip, and an Allen head wrench.

* * * * *